US005494271A

United States Patent [19]

Wun et al.

[11] Patent Number: 5,494,271

[45] Date of Patent: Feb. 27, 1996

[54] TRANSMISSION SYSTEM FOR A DOCUMENT FEEDER

[75] Inventors: Jeffrey Wun, Hsinchu; Steven Chiu, Chia-Yi; Mark Chang, Taipei, all of Taiwan

[73] Assignee: Umax Data Systems Inc., Hsinchu, Taiwan

[21] Appl. No.: 257,570

[22] Filed: Jun. 10, 1994

[51] Int. Cl.[6] ..... B65H 5/06

[52] U.S. Cl. ..... 271/3.01; 271/3.18; 271/3.2; 271/272; 271/314; 74/323; 74/810.1

[58] Field of Search ..... 271/3.01, 3.14, 271/3.18, 3.20, 3.21, 3.24, 114, 198, 272, 275, 314; 74/323, 810.1, 421 R

[56] References Cited

U.S. PATENT DOCUMENTS

| | | | |
|---|---|---|---|
| 2,544,468 | 3/1951 | Noguera | 74/421 R |
| 4,767,114 | 8/1988 | Nishimoto | 271/3.2 |

FOREIGN PATENT DOCUMENTS

| | | | |
|---|---|---|---|
| 0012537 | 1/1987 | Japan | 271/3.01 |
| 0064934 | 3/1989 | Japan | 271/114 |
| 0051242 | 3/1991 | Japan | 271/114 |

*Primary Examiner*—William E. Terrell
*Attorney, Agent, or Firm*—W. Wayne Liauh

[57] ABSTRACT

An improved transmission system for a document feeder, in which a constant one-way-rotating gear train is mounted in an output zone so as to cause a transmission shaft in the output zone to rotate in one direction only to send out a sheet of document no matter the driving gear rotates clockwise or counter-clockwise; therefore, as soon as a first sheet of document moves out of the scanning line without moving out of the output zone, the driving gear will change its rotation clockwise so as to have a next sheet of document fed into the scanning zone; therefore, the feeding distance between two sheets of document will be reduced, and consequently the whole feeding time for a document will be reduced, too.

3 Claims, 7 Drawing Sheets

TRANSMISSION SYSTEM FOR A DOCUMENT FEEDER

BACKGROUND OF THE INVENTION

Under the current tendency of office automation fashion, the copying machine, the printer and the scanning machine, etc. have widely been used for document-processing. In order to elevate the operation efficiency of the scanning machine or the copying machine, an automatic document feeder has been designed and developed to be attached to the aforesaid machines, i.e., a plurality of sheet papers can be fed into the machine continuously and automatically instead of being fed one sheet at a time by a person. The transmission structure of the feeder is shown in FIG. 1, which comprises a scanning zone one-way gear train 10, a feeding zone one-way gear train 11, an output zone one-way gear train 12, and a driving gear 13. The transmission theory is based on a concept that the driving direction of the feeding zone one-way gear train 10 is contrary to that of the scanning zone one-way gear train 11 and the output zone one-way gear train 12. When the driving gear 13 rotates to feed a sheet of paper (for example, to rotate clockwise), the feeding zone one-way gear train 10 moves towards a correct direction to drive a transmission shaft to rotate so as to have the first sheet 15 of document fed to the front of a scanning line 14 (as shown in FIG.2); then, as soon as the first sheet 15 of document is fed to the stand-by position before the scanning line, the driving gear 13 starts to rotate for scanning and output process (i.e., rotating counter-clockwise); at the same time, the feeding zone one-way gear train 10 is unable to drive the transmission shaft to rotate, while the scanning zone one-way gear train 11 and the output zone one-way gear train 12 will drive the corresponding transmission shaft to rotate and to cause the first sheet 15 to pass through the scanning line 14 (as shown in FIG. 3) and to move out of the output zone. As soon as the first sheet 15 moves out completely, the driving gear 13 will restore to the feeding-step, rotation (i.e., rotating clockwise) so as to process a second sheet 16 of document (as shown in FIG. 4), and then the same procedures are repeated automatically to fulfill a document feeding operation.

As pointed out for the aforesaid conventional paper-feeding structure, the feeding distance D1 between two sheets of document is rather large, and therefore the feeding speed can not be elevated to meet the requirement of high speed and high efficiency, i.e., becoming a bottleneck in terms of efficiency.

SUMMARY OF THE INVENTION

This invention relates to an improved transmission system for a document feeder, which comprises a feeding zone gear train, a scanning zone gear train, a driving gear and a constant one-way-rotating gear train. The one-way bearing in each gear can drive a transmission shaft to make one-way rotation. The feature of the document feeder is that an output zone is furnished with a constant one-way rotating gear train so as to have a transmission shaft in the output zone rotated in one way to send out a document no matter the driving gear rotates clockwise or counter-clockwise; therefore, the first sheet of document is un-necessary to leave the output zone completely, but the driving gear has to change into clockwise rotation upon a sheet of paper passing through a scanning line, and then a second sheet of paper will be fed into the scanning zone; consequently, the distance between two sheets fed can be reduced, and the document carrying time in the feeder can also be reduced.

DETAILED DESCRIPTION

Figure 5:
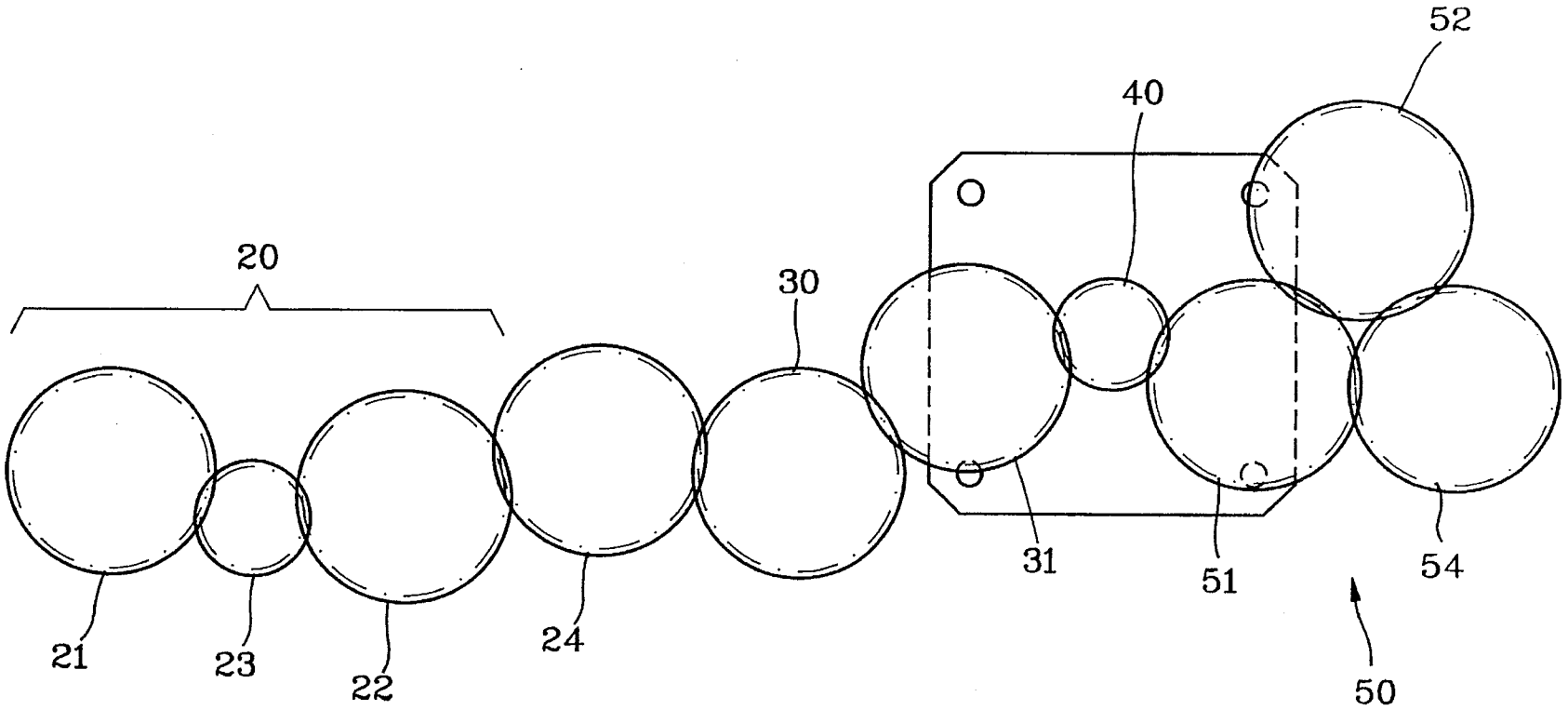
FIG. 5 illustrates an improved transmission system for a document feeder according to the present invention.

Referring to FIG. 5, the improved transmission system for a document fed according to the present invention comprises a feeding zone gear train 20, a scanning zone gear train 30, a driving gear 40 and a constant one-way-rotating gear train 50. The feeding zone gear train 20 includes a front gear 21 and a rear gear 22, which are turned by means of two transmission gears 23 and 24. The scanning zone gear train 30 is driven to rotate by means of a transmission gear 31 which is driven with a driving gear 40. The operation of the aforesaid parts is the same as that of a conventional assembly of the kind, i.e., when the driving gear 40 rotates clockwise or counter-clockwise, only one gear train of the feeding zone gear train 20 or the scanning zone gear train 30 can drive the transmission shaft engaged to rotate.

Figure 6:
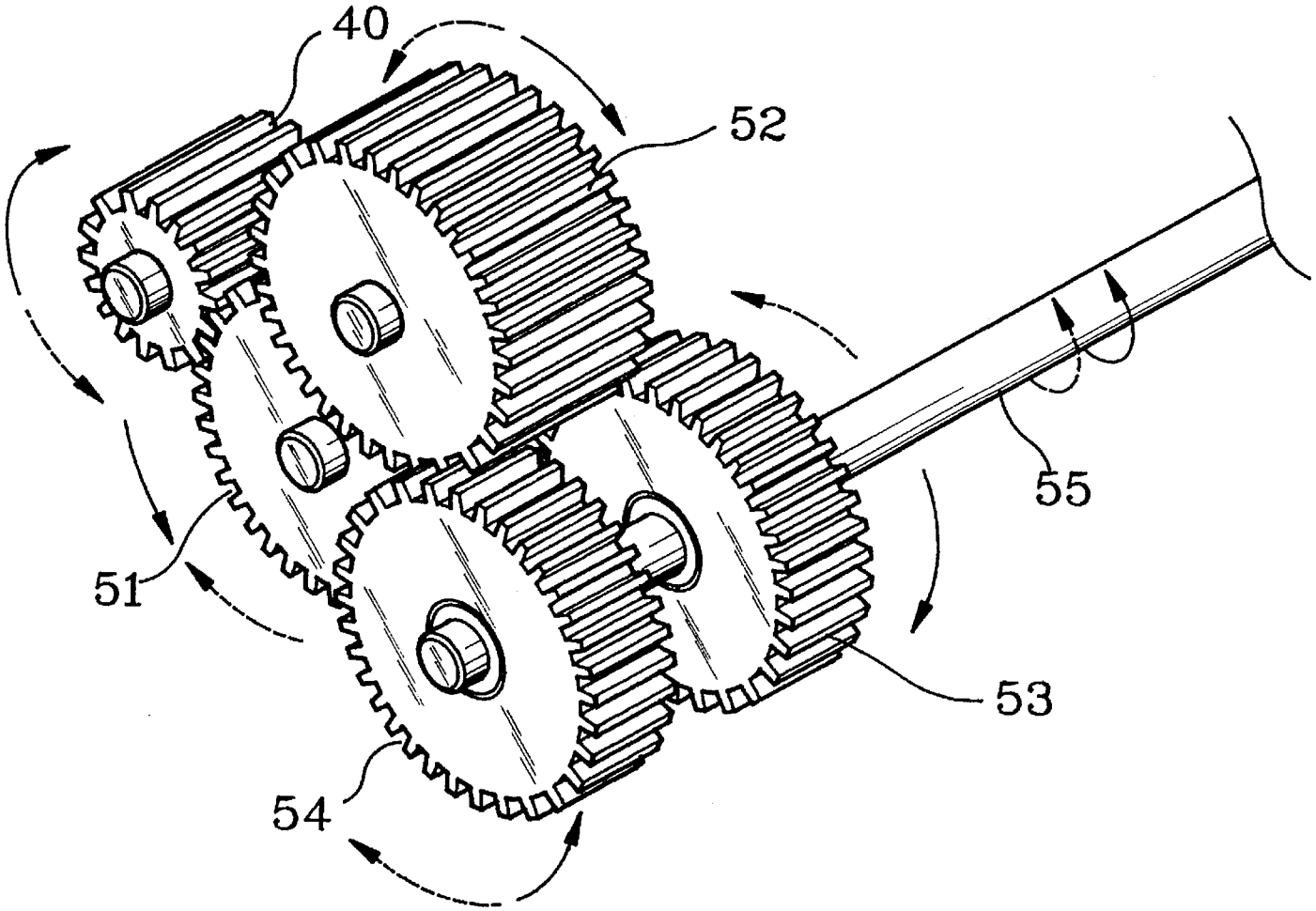
FIG. 6 is a perspective view of a constant one-way-rotating according to the present invention.
Figure 7:
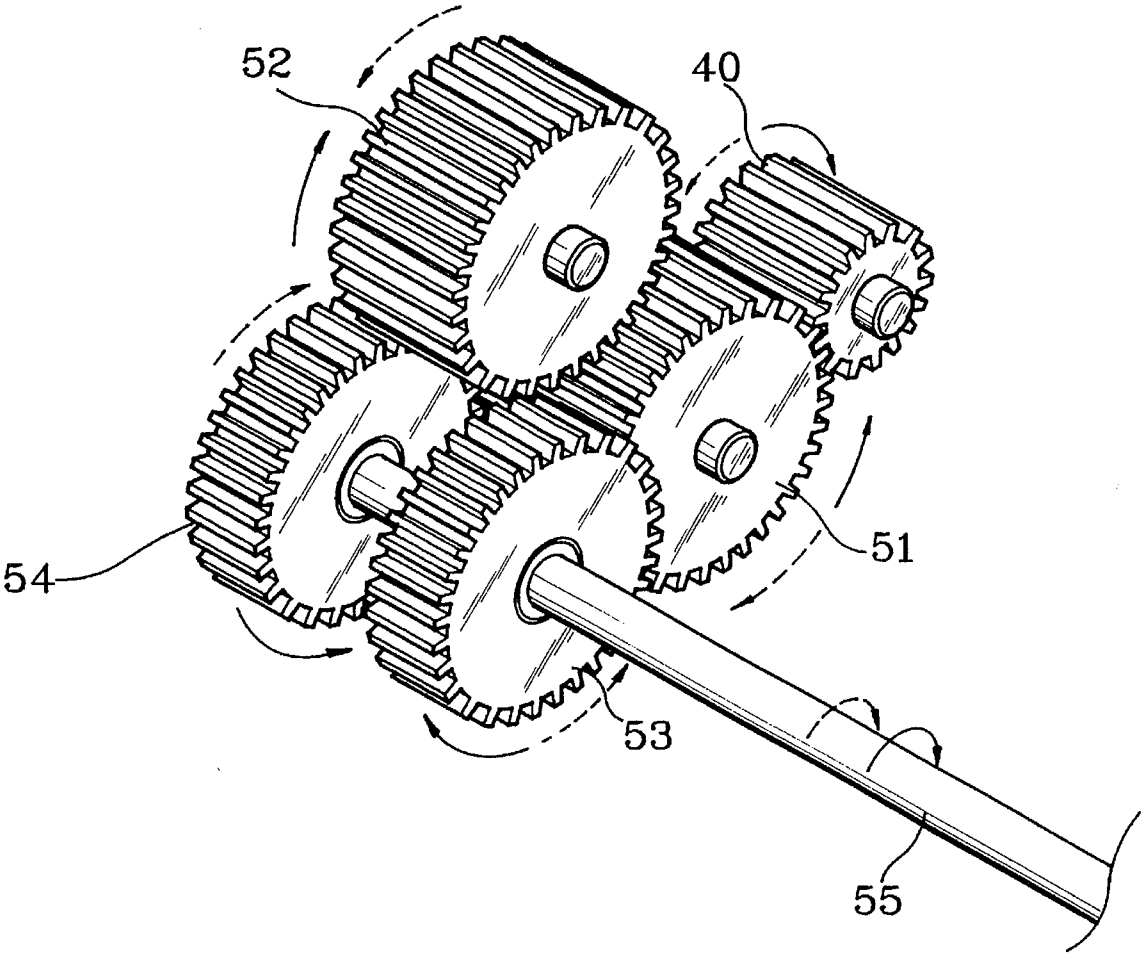
FIG. 7 is another perspective view of a constant one-way-rotating according to the present invention.

The feature of the present invention is that the constant one-way-rotating gear train 50 is used to replace a simple gear usually used in the output zone of the conventional document feeder. The constant one-way-rotating gear train 50 includes a transmission gear 51, an intermediate gear 52, a first gear 53 and a second gear 54 (as shown in FIG. 6). The driving gear 40 is used for driving a transmission gear 51, which drives an intermediate gear 52 and a first gear 53; simultaneously*, the intermediate gear also drives a second gear 54. The first and the second gears 53 and 54 are mounted on one transmission shaft 55, and the one-way bearing in the two gears 53 and 54 can drive the transmission shaft 55 only when the gear is driven to rotate counter-clockwise. When the driving gear 40 rotates clockwise (as shown in FIGS. 6 and 7 with solid lines), the transmission gear 51 will be driven with the driving gear 40 to rotate counter-clockwise; at the same time, the intermediate gear 52 and the first gear 53 will be driven with the transmission gear 51 to rotate clockwise; then, the second gear 54 will be driven with the intermediate gear 52 to rotate counter-clockwise; in that case, the second gear is driven to rotate counter-clockwise, and then the one-way bearing therein will drive the transmission shaft 55 to rotate. Likewise, when the driving gear 40 rotates counter-clockwise (as shown in FIGS. 6 and 7 with dotted lines), the first gear 53 will be driven with the transmission gear 51 to rotate counter-clockwise; as a result, the one-way bearing in the first gear 53 will cause the transmission shaft 55 to rotate. In other words, no matter the driving gear 40 rotates clockwise or counter-clockwise in the constant one-way-rotating gear train 50, one of the first gear 53 or the second gear 54 will rotate counter-clockwise, and the one-way bearing therein will drive the transmission shaft 55 to rotate so as to provide a constant one-way-rotating function.

Figure 1:
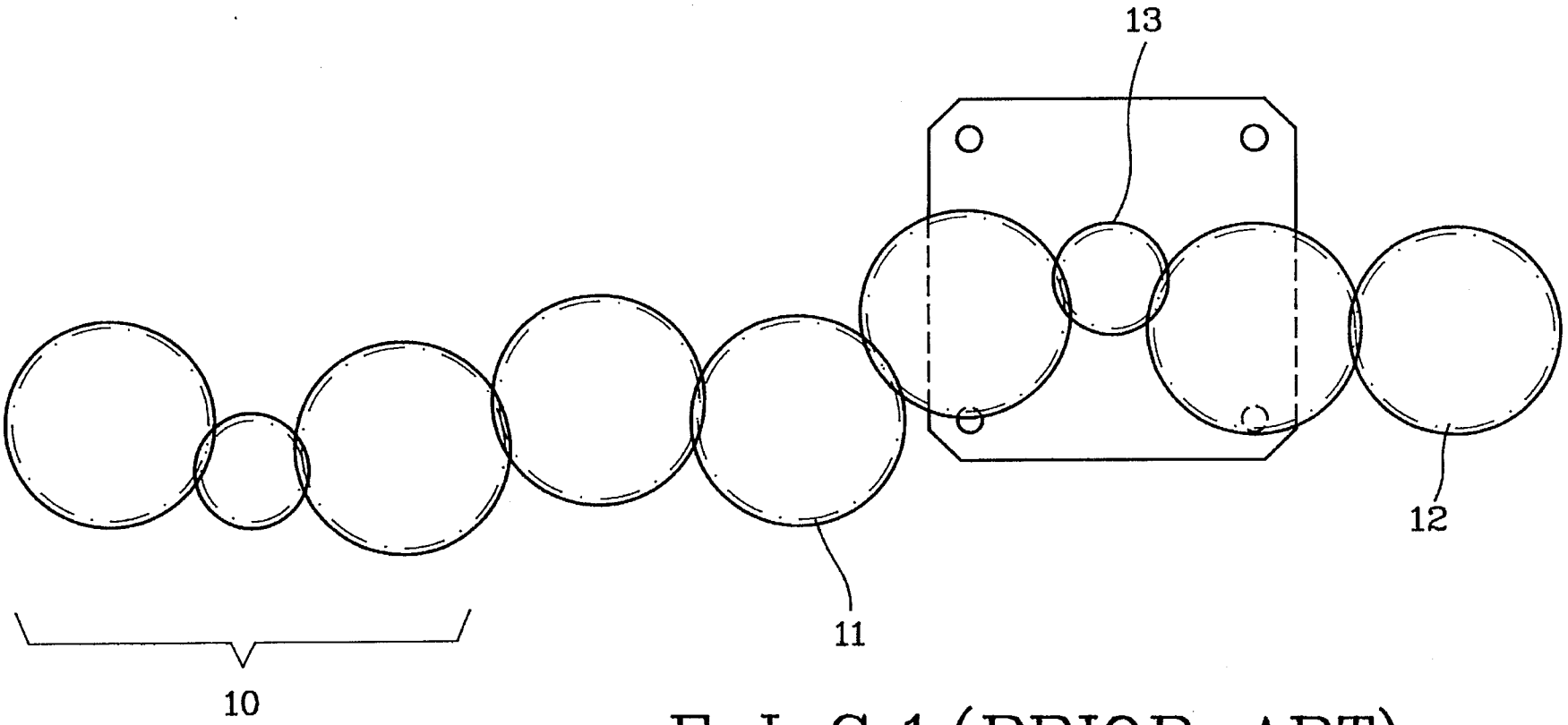
FIG.1 (PRIOR ART)
FIG. 1 illustrates a conventional transmission system for a document feeder.
Figure 2:
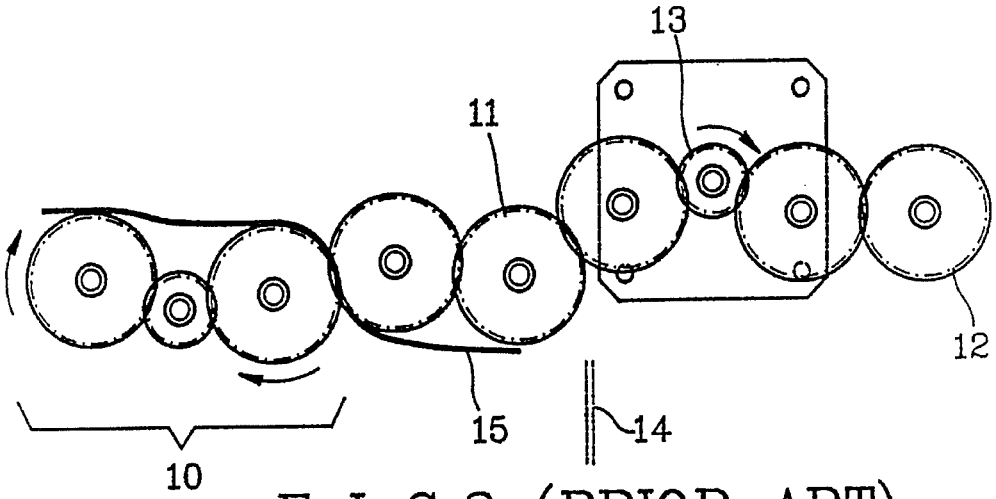
F I G.2 (PRIOR ART)
FIG. 2 is an operation view-1 of the conventional transmission system for a document feeder.
Figure 3:
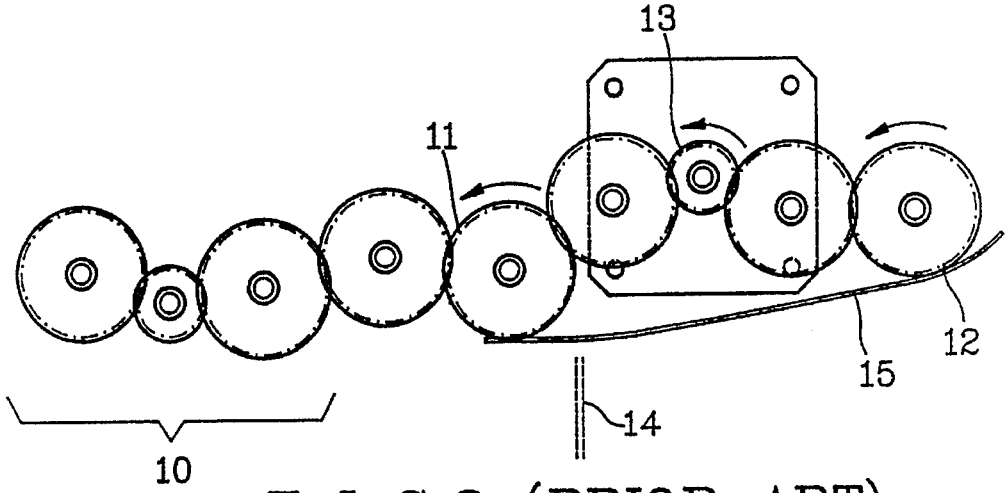
F I G.3 (PRIOR ART)
FIG. 3 is an operation view-2 of the conventional transmission system for a document feeder.
Figure 4:
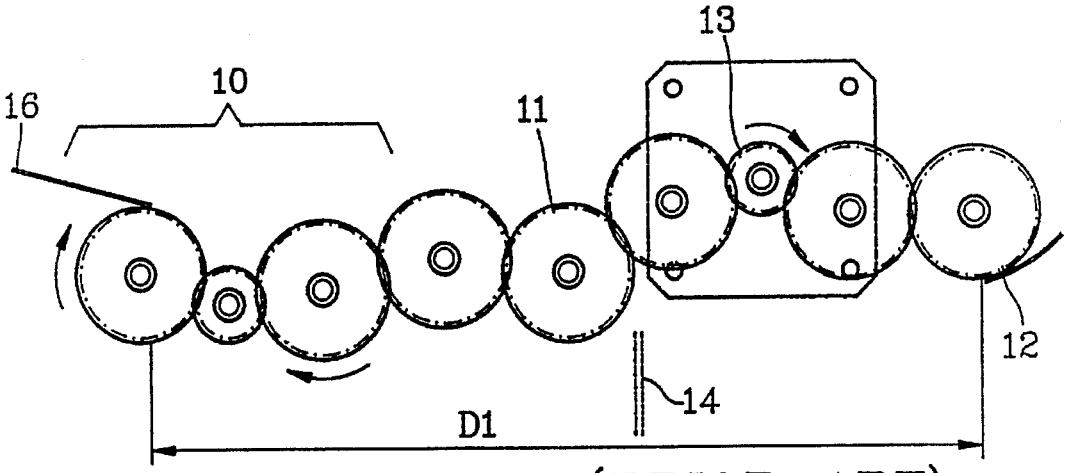
F I G.4 (PRIOR ART)
FIG. 4 is an operation view-3 of the conventional transmission system for a document feeder.
Figure 8:
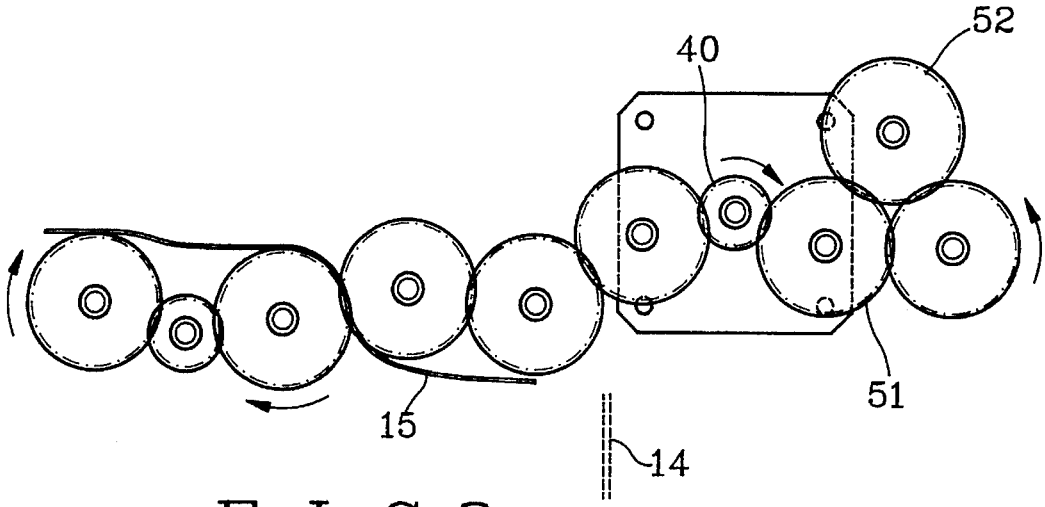
FIG. 8 illustrates an operation view-1 of the present invention.
Figure 9:
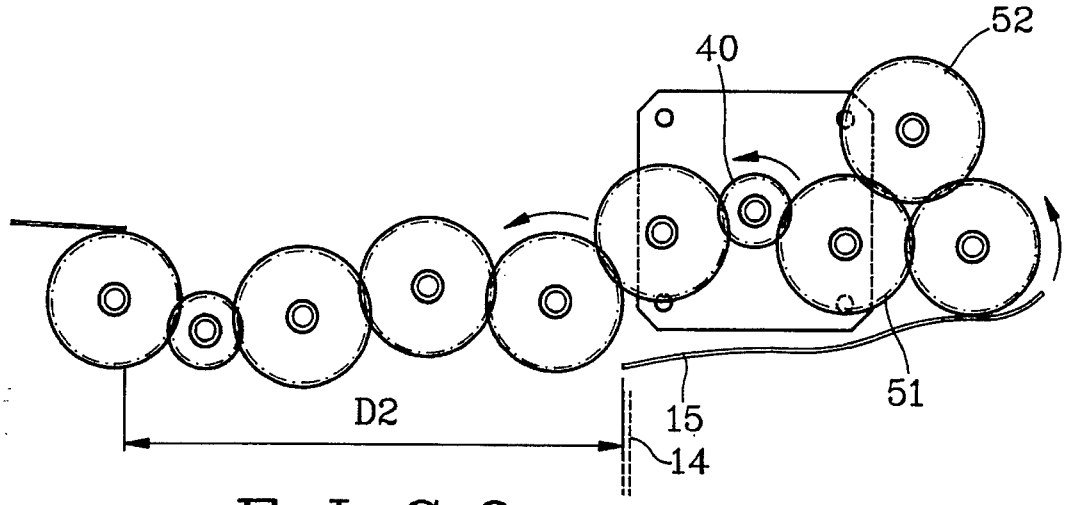
FIG. 9 illustrates an operation view-2 of the present invention.
Figure 10:
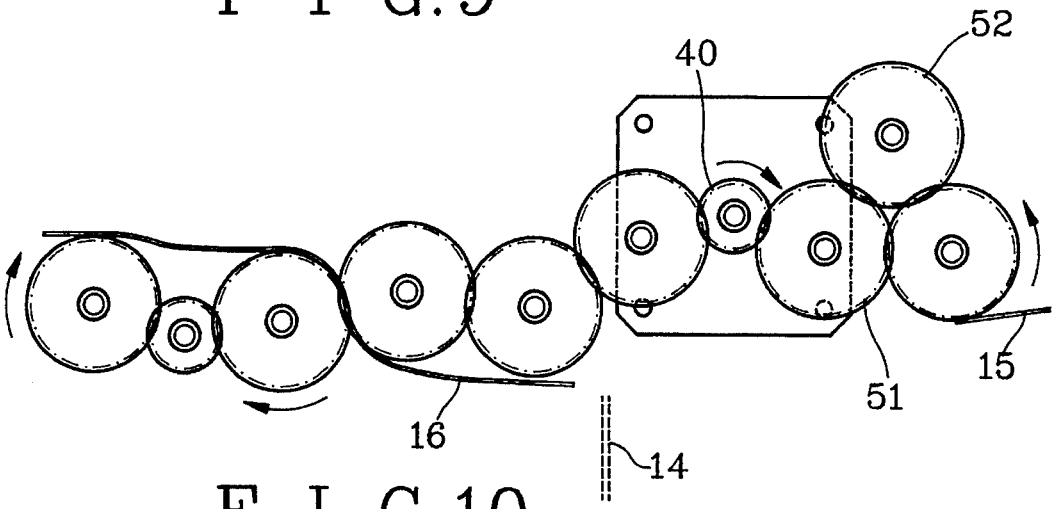
FIG. 10 illustrates an operation view-3 of the present invention.

For the actual feeding operation of the present invention, refer to FIGS. 8, 9 and 10; the operation of the present invention may be compared with that of the conventional document feeder as shown in FIGS. 2, 3 and 4. The prime difference between them is that, when a sheet of document scanned, is moved out of the scanning roller position, the driving gear 40 will restore to the condition of clockwise rotation to be ready for feeding the next sheet of document (as shown in FIGS. 9 and 10), and therefore the distance between a former and a latter sheets of document can be less than a distance of D2. A comparison between the operation as shown in FIGS. 4 and 10 will show that the present invention will have a high feeding efficiency.

Figure 11:
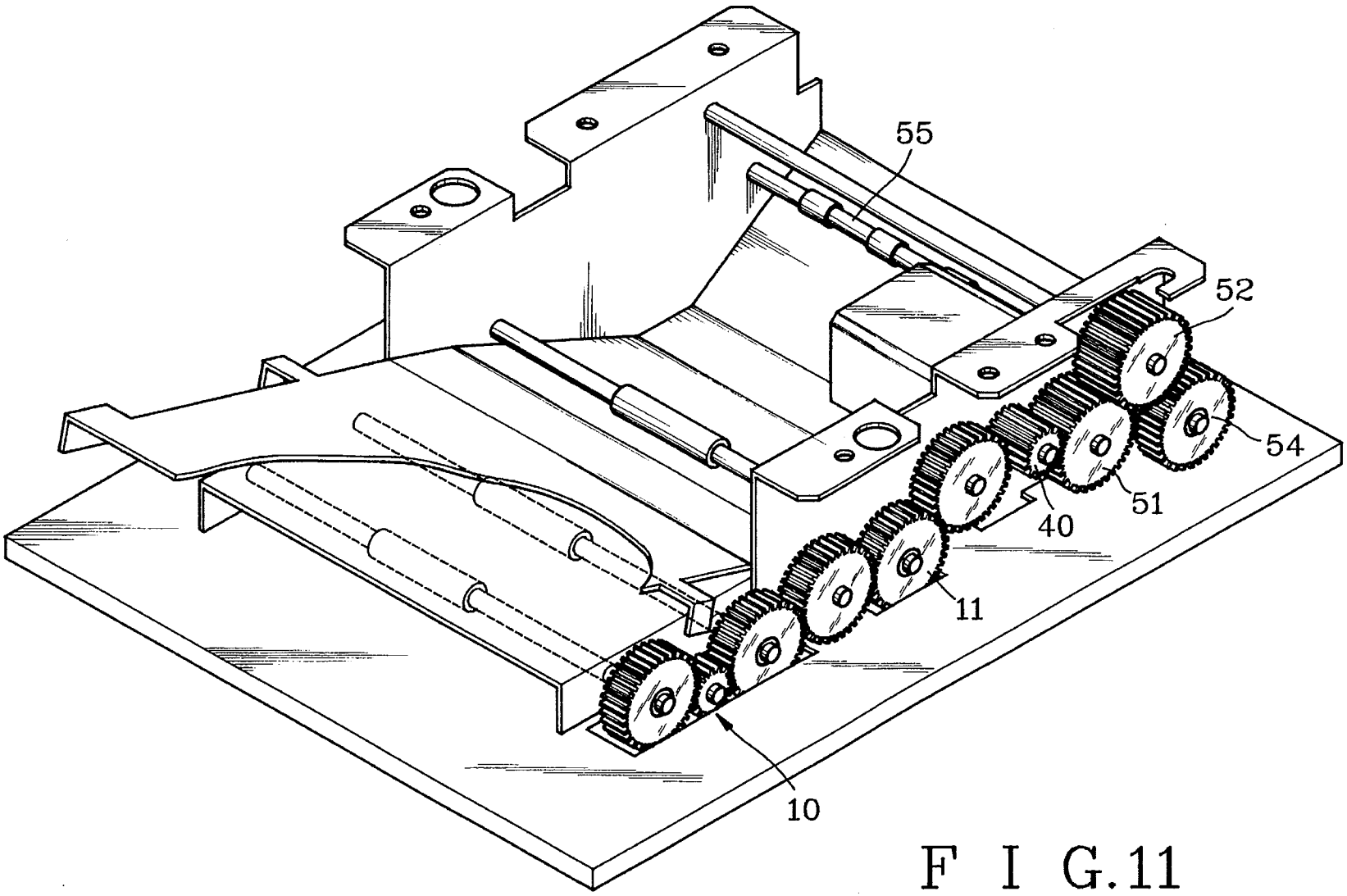
FIG. 11 is a perspective view of an embodiment according to the present invention.

In real operation, the present invention not only can be used in an optical scanning type of automatic document feeder, but also can be used in a draft automatic feeder of a copying machine. The structure thereof can be varied in accordance with different requirement (as shown in FIG. 11); in other words, the present invention should not be limited with the structure as shown in the embodiment thereof.

We claim:

1. An improved transmission system for a document feeder comprising a driving gear to drive a gear train for feeding document, and said gear train comprising at least a transmission gear, an intermediate gear, a first gear and a second gear; said transmission gear being driven with said driving gear; said intermediate gear and said first gear also being driven with said transmission gear; said intermediate gear driving said second gear; said first gear and said second gear rotating in opposite directions so as to cause one-way bearings of said first gear and said second gear to drive a transmission shaft thereof upon said driving gear rotating either clockwise or counter-clockwise, allowing said transmission shaft to rotate in one direction only to send one sheet of document out of said feeder.

2. An improved transmission system for a document feeder as claimed in claim 1, wherein said gear train includes at least a feeding zone gear train to feed a sheet of document into a scanning position.

3. An improved transmission system for a document feeder as claimed in claim 1, wherein said gear train includes at least a scanning zone gear train to feed a sheet of document forwards upon scanning.

* * * * *